US012616268B2

(12) United States Patent
Axelsson

(10) Patent No.: US 12,616,268 B2
(45) Date of Patent: May 5, 2026

(54) CHIN PROTECTOR, ASSEMBLY AND KIT OF PARTS THEREWITH AND METHOD OF RETROFITTING A CHIN PROTECTOR

(71) Applicant: 3M INNOVATIVE PROPERTIES COMPANY, St. Paul, MN (US)

(72) Inventor: Peter L. Axelsson, Borlänge (SE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 18/245,336

(22) PCT Filed: Sep. 14, 2021

(86) PCT No.: PCT/IB2021/058356
§ 371 (c)(1),
(2) Date: Mar. 14, 2023

(87) PCT Pub. No.: WO2022/058884
PCT Pub. Date: Mar. 24, 2022

(65) Prior Publication Data

US 2023/0354945 A1 Nov. 9, 2023

(30) Foreign Application Priority Data

Sep. 15, 2020 (EP) ..... 20196302

(51) Int. Cl.
*A42B 3/20* (2006.01)
*A42B 3/22* (2006.01)

(52) U.S. Cl.
CPC ..... *A42B 3/205* (2013.01); *A42B 3/225* (2013.01)

(58) Field of Classification Search
CPC ..... A42B 3/205; A42B 3/225; A42B 3/20; A42B 1/08; A62B 7/10; A41D 13/11; A41D 13/1184
See application file for complete search history.

(56) References Cited

U.S. PATENT DOCUMENTS 2,758,307 A * 8/1956 Treiber ..... A41D 13/1184 2/9
4,748,695 A 6/1988 Shigematsu et al.
(Continued)

FOREIGN PATENT DOCUMENTS

CN 103120435 12/2015
DE 102006035226 A1 1/2008
(Continued)

OTHER PUBLICATIONS

1507 Extended EP Search Report for EP20196302.2, Date Mar. 10, 2021, 3pgs.
(Continued)

*Primary Examiner* — Uyen T Nguyen

(57) ABSTRACT

The present disclosure relates to a chin protector 10, 10', 10" to be attached to a protective face shield 100, 100' or a protective helmet 200. The present disclosure further relates to an assembly 300, 300' of a protective face shield 100, 100' and a chin protector 10, 10', 10" as well as to an assembly 400 of a protective helmet 200 and a chin protector 10, 10', 10". Moreover, the present disclosure relates to a kit of parts comprising a protective face shield 100, 100' and a chin protector 10, 10', 10" as well as to a method of retrofitting a protective face shield 100, 100' with a chin protector 10, 10', 10". The chin protector 10, 10', 10" is provided generally planarly and is bendable to a curved configuration for use. The chin protector 10, 10', 10" is easily and quickly attachable to a protective face shield 100, 100' or a protective helmet 200 and provides for an increased freedom of selection.

7 Claims, 8 Drawing Sheets

(56) References Cited

U.S. PATENT DOCUMENTS

| | | | | |
|---|---|---|---|---|
| 4,793,001 | A | 12/1988 | Accardi | |
| 4,945,573 | A * | 8/1990 | Landis | A41D 13/1184 351/158 |
| 5,104,430 | A * | 4/1992 | Her-Mou | A62B 18/006 128/206.17 |
| 5,704,063 | A * | 1/1998 | Tilden | A41D 13/1161 2/427 |
| 5,878,742 | A * | 3/1999 | Figueredo | A62B 18/003 128/201.24 |
| 7,152,253 | B2 | 12/2006 | Abelman et al. | |
| 7,197,774 | B2 * | 4/2007 | Curran | A61F 9/068 128/201.25 |
| 8,291,512 | B2 | 10/2012 | Stoll | |
| 11,470,906 | B2 | 10/2022 | Basson et al. | |
| 2010/0125934 | A1 * | 5/2010 | Green | A42B 3/286 2/424 |
| 2010/0229870 | A1 * | 9/2010 | Green | A42B 3/286 128/205.27 |
| 2016/0050990 | A1 * | 2/2016 | Hayes | A42B 1/0181 2/9 |
| 2017/0079364 | A1 * | 3/2017 | Paulson | A42B 3/222 |
| 2021/0128953 | A1 * | 5/2021 | McCoy | A62B 23/02 |
| 2021/0195980 | A1 * | 7/2021 | Cartwright | A62B 18/045 |
| 2021/0267804 | A1 * | 9/2021 | Huh | A61F 9/06 |
| 2021/0282476 | A1 * | 9/2021 | Memita | A61F 9/045 |
| 2021/0298389 | A1 * | 9/2021 | Filko | A62B 18/025 |
| 2021/0337912 | A1 * | 11/2021 | Durocher | A42B 3/205 |

FOREIGN PATENT DOCUMENTS

| | | | |
|---|---|---|---|
| EP | 2189074 | A2 | 5/2010 |
| FR | 2890538 | B1 | 11/2007 |
| FR | 3016498 | B1 | 5/2016 |

OTHER PUBLICATIONS

International Search Report for PCT International Application No. PCT/IB2021/058356, mailed on Dec. 14, 2021, 4 pages.

* cited by examiner

CHIN PROTECTOR, ASSEMBLY AND KIT OF PARTS THEREWITH AND METHOD OF RETROFITTING A CHIN PROTECTOR

CROSS REFERENCE TO RELATED APPLICATIONS

This application is a national stage filing under 35 U.S.C. 371 of PCT/IB2021/058356, filed Sep. 14, 2021, which claims the benefit of EP Application Serial No. 20196302.2, filed Sep. 15, 2020, the disclosure of which is incorporated by reference in its/their entirety herein.

The present disclosure relates to a chin protector to be attached to a protective face shield or a protective helmet. The present disclosure further relates to an assembly of a protective face shield and a chin protector as well as to an assembly of a protective helmet and a chin protector. Moreover, the present disclosure relates to a kit of parts comprising a protective face shield and a chin protector as well as to a method of retrofitting a protective face shield with a chin protector.

Chin protectors are widely used as an addition to a protective face shield when protecting the wearer's face and neck including the chin. Simple chin protectors, e. g. known as chin cups, may be part of a strap holding such a face shield or a protective helmet in place, wherein the chin protector is cup-shaped and directly contacts the chin of the wearer. More sophisticated chin protectors—in particular to protect a wearer against—for example—spatter of different kind as well as radiation or fumes, have been developed such that chin protectors, as part of a protective face shield being attached thereto, are spaced from the wearer's chin and are held in a configuration surrounding the wearer's chin. Surrounding the wearer's chin is understood as being arranged in the curved configuration at a distance around the chin, preferably equidistant relative to the chin at least partially over the extension of the chin protector. Such chin protectors may, for example, be molded and integral with the protective face shield. Alternatively, the chin protector may be attached to the protective face shield by way of gluing or using a connection element thereby forming an assembly of a protective face shield and a chin protector. For example, FR 2 890 538 describes such a chin protector being attached to a protective face shield.

An important factor of face shields may be their transparency in order to provide undisturbed view of a wearer to the area in front of the wearer. While chin protectors attached to the face shield may provide sufficient protection, these may to some degree disturb the wearer's view, in particular at the connection between the chin protector and the protective face shield. An attempt to overcome this disadvantage is to integrally mold the chin protector and the protective face shield. However, this limits the flexibility of chin protectors relative to size and shape, material and other properties. Also, change of a chin protector is only possible when the whole assembly is changed.

Therefore a need exists for a chin protector which overcomes the above-mentioned disadvantages and provides simultaneously protection as well as good viewing conditions to the wearer. Also, it is an object of the present disclosure to provide a chin protector which gives some freedom to the wearer when selecting the chin protector regarding size, shape and/or material of the chin protector. Furthermore, it is an object of the present disclosure to provide an easy to handle chin protector.

The present disclosure relates to a chin protector for attachment to a protective face shield arrangeable in front of a wearer's face or to a protective helmet. The protective face shield has an inner major surface facing—in use—towards the face of the wearer and an outer major surface facing—in use—away from the wearer's face. The chin protector exhibits—when not in use—a generally planar configuration, wherein the chin protector is bendable such that it can be brought from the generally planar configuration into a curved configuration. The chin protector is attachable to the protective face shield. The chin protector is configured to be attached in the curved configuration to the inner major surface of the protective face shield such that—in use—the chin protector is maintained in the curved configuration thereby surrounding the chin of a wearer of the protective face shield. The attachment of the chin protector may be with at least one portion thereof, preferably with the entire edge of the chin protector facing towards the inner major surface of the protective face shield. The chin protector further comprises an inner and an outer major surface. The inner major surface faces—in use—towards the wearer's chin and the outer major surface faces—in use—away from the wearer's chin. The advantage of a chin protector according to the present disclosure is to provide a chin protector with an easy and quick attachment to a protective face shield worn by the wearer while providing protection to the wearer's chin and face. The chin protector thereby provides protection from ingress of dust, dirt, droplets or other moving objects or particles, in particular from a direction coming from below.

In particular, compared to chin protectors which are fixed or integral with a protective face shield, the chin protector can be selected and attached independent of the protective face shield. For example, if a protective face shield of a certain type, shape, material and/or size is used, the selection of the chin protector is not bound to the selected protective face shield, but can be done in accordance with the wearer's needs or desires in regard to type, shape, material and/or size. Therefore, the chin protector according to the present disclosure provides more freedom of selection of a chin protector for a protective face shield compared to a chin protector already fixed to a protective face shield. The same advantages apply for the attachment of the chin protector to a protective helmet. The attachment of the chin protector to the protective face shield may be releasable, i. e. such that the chin protector is detachable from the protective face shield once it was attached. The advantage of a releasable attachment may be that the chin protector can easily be stored in a generally planar configuration when not in use, i. e. prior to use as well as after use. Alternatively, the attachment of the chin protector to the protective face shield may be non-releasable, i. e. such that it cannot be detached or removed anymore. This may provide for a strong and reliable connection between chin protector and protective face shield. The attachment of the chin protector may be at a portion at the edge thereof. Alternatively, the attachment may be at one or both of the major surfaces of the chin protector, for example the portion of attachment may be 10 to 30 mm inwards from the edge of the chin protector/protective face shield. Also, the chin protector according to the present disclosure provides for an easy handling, in particular a retrofitting of an existing protective face shield with such a chin protector is possible. The wearer of such a chin protector has some freedom to select a chin protector of appropriate type, size, shape and material even if a protective face shield is already present. Another advantage may be that—because the chin protector can be provided independent of a protective face shield to which the chin protector is to be attached—that the chin protector can be replaced if damaged independent from the protective face shield. Furthermore, in case the protective face shield is damaged, e. g. scratched, the protective face shield can be replaced with a new one and the chin protector can be further used therewith. Suitable materials, depending on the required properties of the chin protector, may include polymeric materials, metals, glass, composites or combinations thereof. The dimensions of a chin protector may depend on the wearer of a protective face shield to which the chin protector is to be attached. Typically, the chin protector exhibits a longitudinal shape with rather rounded edge portions, i. e. to avoid sharp edges. For example, the longitudinal shape may have an extension in the range of 25 to 75 cm in length and 5 to 10 cm in width. The chin protector is typically formed by a sheet-like material having a thickness of below 10 mm, preferably below 5 mm, most preferred below 2 mm. The chin protector may comprise further components such as e. g. a frame surrounding the chin protector. Such a frame may help to provide higher stability of the chin protector. Also, a frame may help with the attachment of the chin protector to a protective face shield.

Furthermore, the present disclosure relates to an assembly of a protective face shield arrangeable in front of a wearer's face and a chin protector according to the present disclosure. The protective face shield has an inner major surface facing—in use—towards the face of the wearer and an outer major surface facing—in use—away from the wearer's face. The chin protector exhibits a curved configuration wherein the chin protector is attached in the curved configuration to the inner major surface of the protective face shield such that the chin protector is maintained in the curved configuration thereby surrounding—in use—the chin of a wearer of the protective face shield. The chin protector further comprises an inner and an outer major surface. The inner major surface faces—in use—towards the wearer's chin and the outer major surface faces—in use—away from the wearer's chin. The attachment of the chin protector to the protective face shield may be releasable, i. e. such that the chin protector is detachable from the protective face shield once it was attached. The advantage of a releasable attachment may be that the chin protector can easily be stored in a generally planar configuration prior to use as well as after use. This may particularly be important if also the protective face shield, which is typically in a curved configuration during use and may even be attached to e. g. a protective helmet, is also releasable from the helmet. Alternatively, the attachment of the chin protector to the protective face shield may be non-releasable, i. e. such that it cannot be detached or removed anymore. This may provide for a strong and reliable connection between chin protector and protective face shield. As outlined above, the typical dimensions of the chin protector in its generally planar configuration are 25 to 75 cm in length, 5 to 10 cm in width and below 10 mm, preferably below 5 mm, most preferred below 2 mm in thickness. The attachment of the chin protector may be at a portion at the edge thereof. Alternatively, the attachment may be at one or both of the major surfaces of the chin protector, for example the portion of attachment may be 10 to 30 mm inwards from the edge of the chin protector/protective face shield. As also mentioned above, the chin protector may comprise further components such as e. g. a frame surrounding the chin protector. Such a frame may help to provide higher stability of the chin protector.

Also, a frame may help with the attachment of the chin protector to a protective face shield. The advantages of such an assembly are similar to the advantages as outlined above for the chin protector, i. e. easy and quick attachment of the chin protector to the protective face shield and freedom of selection of a chin protector for a protective face shield. An advantage of the assembly is also, that the chin protector and the protective face shield are already pre-assembled, i. e. ready for use.

Moreover, the present disclosure relates to an assembly of a protective helmet and a chin protector according to the present disclosure. The chin protector exhibits a curved configuration. The chin protector is attached to the protective helmet by attachment means in the curved configuration such that the chin protector is maintained in the curved configuration thereby surrounding the chin of a wearer of the protective helmet. As outlined above for the chin protector and the assembly of a protective face shield with a chin protector, the attachment may be releasable (i. e. chin protector is detachable from the protective helmet) or non-releasable (i. e. chin protector is not releasable from the protective helmet). As explained, the advantage of a releasable attachment is that the chin protector may be stored in a generally planar configuration when not in use, whereas the advantage of a non-releasable attachment may be that the chin protector has a strong and reliable connection to the protective helmet. The attachment means may be separate parts or may belong to the protective helmet and/or to the chin protector. The assembly optionally comprises a protective face shield having an inner major surface facing—in use—towards the face of a user and an outer major surface facing—in use—away for the wearer's face, wherein the chin protector is optionally attached to the protective face shield. The attachment between the protective face shield and the chin protector may be at the edge and/or at one or both major surfaces of the chin protector. The attachment means may be separate parts or may belong to the protective face shield and/or to the chin protector. In addition, the protective face shield may optionally be attached to the protective helmet. Similar to the assembly of a protective face shield and a chin protector, the protective face shield in this embodiment may comprise further components, e. g. a frame for stabilization. The advantages of such an assembly are similar to the advantages as outlined above for the chin protector and for the assembly of a chin protector and a protective face shield, respectively, i. e. easy and quick attachment of the chin protector to the protective face shield and freedom of selection of a chin protector for a protective face shield. An advantage of the assembly is also, that the chin protector and the protective helmet are already pre-assembled, i. e. ready for use.

Furthermore, the present disclosure relates to a kit of parts comprising a chin protector according to the present disclosure and a protective face shield having an inner major surface facing—in use—towards the face of the wearer and an outer major surface facing—in use—away from the wearer's face. The chin protector and/or the protective face shield may be provided in a generally planar configuration in the kit of parts, which has some benefit regarding storage and shipping of the kit of parts. It is also conceivable that the chin protector and/or the protective face shield are provided in a curved configuration, i. e. ready for attachment or use. This may help with the attachment of the chin protector to the protective face shield. The kits of parts may further comprise attachment means for attaching the chin protector to the protective face shield. The attachment means may be attached to the chin protector and/or the protective face shield. The attachment means are configured and arranged such that the chin protector engages with its attachment means a portion of the protective face shield and/or the protective face shield engages with its attachment means a portion of the chin protector, preferably the attachment means of the chin protector and of the protective face shield engage with each other. It is also conceivable that the attachment means are separate from the chin protector and the protective face shield. In this case, the attachment means are configured such that a portion of the chin protector as well as a portion of the protective face shield is engageable by the attachment means. If the chin protector or the protective face shield already comprises attachment means, the separate attachment means are configured to engage with the attachment means of the chin protector or of the protective face shield. The advantage of such an assembly is that a chin protector which fits regarding shape, size, material and/or type relative to the protective face shield is provided with the protective face shield in the kit of parts. In other words, while having less freedom for the selection of the chin protector, a wrong selection of a chin protector relative to the protective face shield is avoided thereby. The advantage of providing a chin protector is outlined above. The advantage of a kit of parts is that all necessary components, i. e. the protective face shield and the chin protector, are provided at once.

Moreover, the present disclosure relates to a method of retrofitting a protective face shield with a chin protector according to the present disclosure. The method comprises the steps of a) providing a protective face shield having an inner major surface facing—in use—towards the face of a wearer and an outer major surface facing—in use—away from the wearer's face, b) providing a chin protector according to the present disclosure in a generally planar configuration, c) bending the chin protector to bring the chin protector from the generally planar configuration into a curved configuration such that at least one portion of the chin protector is engageable with a portion of the protective face shield and d) attaching the chin protector in that curved configuration with the at least one portion to a portion of the inner major surface of the protective face shield such that the chin protector is maintained in the curved configuration and such that—in use—the chin protector surrounds the chin of the wearer or the method comprises the steps of a') providing a protective face shield having an inner major surface facing—in use—towards the face of a wearer and an outer major surface facing—in use—away from the wearer's face, b') providing a chin protector according to the present disclosure in a generally planar configuration, c') attaching the chin protector in that planar configuration with at least one portion to a portion of the inner major surface of the protective face shield and d') bending the at least one portion of the chin protector to bring that portion of the chin protector from the generally planar configuration into a curved configuration, wherein the steps c and d are repeated until the chin protector is completely attached to the protective face shield. The advantage of such a method is that a protective face shield initially not having a chin protector can be equipped with a chin protector thereby providing increased protection of the wearer of the protective face shield, in particular of the chin and parts of the face and neck. The method of retrofitting provides for an easy and quick attachment to a protective face shield worn by the wearer. A chin protector of a specific type, size, shape and material can be used with an existing protective face shield. The method of retrofitting may be carried out by a wearer, i. e. the end-user of a protective face shield and a chin protector, respectively. Alternatively, the method may be carried out by a manufacturer or distributor of a protective face shield and a chin protector, respectively.

Typically, the chin protector has—when not in use—a substantially longitudinal shape having two major surfaces and an edge. The longitudinal shape typically exhibits two ends opposite to each other. Typically, the chin protector is made by punching or cutting-off the required shape from a sheet material. Other methods are conceivable, e. g. a chin protector made by extrusion of a generally planar material.

Protective face shields, also known as visors, are understood as a part of personal protective equipment to protect the wearer of it, in particular the face of the wearer and parts of the head and neck from being impacted by hazards due to flying objects which may otherwise hit and injure or contaminate the skin, eyes, ears etc. of the wearer. Preferably, a protective face shield comprises or consists of a transparent or translucent material, depending on the use and the working conditions of the wearer. Protective face shields may be used in private environments, in manufacturing, medical environment or for other uses. Protective face shields are typically made of sheets of polycarbonate or cellulose acetate, although other materials are conceivable, through extrusion or injection molding, although other ways of making are conceivable. Protective face shields may comprise further components than just the sheet-like material, e. g. a frame to stabilize the protective face shield. Typically, protective face shields are—in use—in a curved configuration such that the wearer's face is surrounded, at least partially. When not in use, the protective face shield may exhibit a generally planar shape.

The term "in use" is understood as the state when a wearer of a protective face shield and/or protective helmet, to which the chin protector according to the present disclosure is attachable, wears the protective face shield and/or the protective helmet. It is also understood that preparing for the wearing, i. e. attaching the chin protector according to the present disclosure to either a protective face shield or a protective helmet, is also included in the state "in use", even if the protective face shield or the protective helmet is not yet worn. The same holds true for the condition after removing the protective face shield or the protective helmet from the wearer's head but having the chin protector still attached to the protective face shield or the protective helmet. This also includes the removal procedure of the chin protector from the protective face shield or from the protective helmet.

The term "not in use" is understood to include prior to use and/or after use, i. e. when the chin protector is not attached to a protective face shield or to a protective helmet.

The term "curved configuration" is understood to be different from a generally planar configuration. In particular, "curved" is understood such that one end of the chin protector is bent towards the other, opposite end of the chin protector so that the chin protector substantially forms a u-shape. In other words, the chin protector is bent around an axis being parallel to a major surface thereof.

In one embodiment, the chin protector comprises attachment means which are engageable with a portion of the protective face shield to attach the chin protector to the protective face shield. For example, such attachment means may be arranged at the edge of the chin protector such that these are engageable with a portion of a protective face shield, to which the chin protector is attachable. The attachment means may protrude planarly from the chin protector. Alternatively, the attachment means may be arranged in or can be brought into an angle relative to the planar configuration of the chin protector. The attachment means may protrude from the edges of the chin protector. Alternatively, the attachment means may protrude from one or both of the major surfaces of the chin protector. In use, the chin protector is arrangeable at the protective face shield such that it surrounds the chin of a wearer of the protective face shield. The attachment means may be integral with the chin protector or, alternatively, the attachment means may be separate parts engageable with the chin protector. In case of separate attachment means, the engagement to the chin protector may be releasable, i. e. the attachment means are detachable after having been engaged with the chin protector, or alternatively, the engagement between the attachment means and the chin protector may be non-releasable, i. e. the attachment means cannot be detached from the chin protector anymore. As outlined above, the attachment of the chin protector, i. e. the engagement of the attachment means of the chin protector to the protective face shield, to the protective face shield may be releasable or non-releasable. For example, the curved configuration of the chin protector in use is arranged such that the round portion faces downwards and that the chin is—in use—positioned between the two end portions of the chin protector in its curved configuration. Typically, the distance between the chin protector and the wearer's chin is less than 15 cm, preferably less than 10 cm, more preferred less than 5 cm. Usually, a minimum distance between the chin protector and the chin is desired, e. g. 1 or 2 cm or more, in order to facilitate movement of the wearer's chin. The advantage of such attachment means is that an easy, quick and reliable way of attaching the chin protector to the protective face shield is achieved therewith.

In a further certain embodiment, the attachment means of the chin protector comprises a protrusion, preferably a pin protruding perpendicular from the attachment means, wherein the protrusion is configured and arranged to engage with a receptacle of the protective face shield. The protrusion optionally comprises a compressible enlarged portion. The attachment means optionally each comprise a bar, from which the protrusion, preferably the pin protrudes. For attachment, the bar may be bent to some extent so that the protrusion, preferably the pin, is in the right orientation to be engaged with the receptacle. In case of a compressible enlarged portion present at the protrusion, this portion may be compressed and engaged with the receptacle such that the compressed portion releases when engaged thereby achieving a reliable mechanical attachment. It is also conceivable that the attachment means are configured and arranged such that no bending is necessary for attachment. Alternatively, the protective face shield may comprise attachment means comprising a protrusion, preferably a pin protruding from the protective face shield, and preferably a bar, so that the protrusion preferably protrudes from the bar, wherein the protrusion is configured and arranged to engage with a receptacle, e. g. a hole, of the chin protector, the protrusion preferably comprises a compressible enlarged portion. The engagement in this alternative works similarly as outlined above for the bar and protrusion arranged at the chin protector. As also outlined above, the attachment of the chin protector to the protective face shield may be releasable or non-releasable. Whether or not the attachment is releasable may also depend on the way of attachment. For example, when using mechanical attachment means (as will be outlined in more detail below for the assembly of a chin protector and a protective face shield), the attachment may preferably be releasable. On the other hand, when using—for example—an adhesive as attachment means, the attachment may preferably not be releasable. The advantage of such attachment means is that an easy, quick and reliable way of attaching the chin protector to the protective face shield is achieved therewith even to a higher degree.

In another embodiment, the chin protector comprises an optically transparent material. For example, the transmission for light in the visible spectrum of the material of the chin protector may be at least 70%, preferably at least 80%, more preferred at least 90% measured according to EN 166:2002-04. It is also conceivable that some parts or portions of the chin protector are not transparent. For example, the chin protector may comprise a non-transparent frame or a non-transparent edge portion made of a soft material for contacting the chin and the skin of the wearer. Preferably, the chin protector consists of an optically transparent or optically clear material. Such materials may include polymeric materials, in particular thermoplastic or thermoset materials. Also, amorphous material such as glass may be suitable as optically transparent material. The advantage of such an optically transparent material is that the viewing conditions, in particular downwards, for the wearer of a protective face shield to which the chin protector is attachable are not or are only to a low degree disturbed by the chin protector. This may be of importance for the wearer when moving, e. g. walking around in a working environment, in order to be able to see obstacles etc. being in the wearer's walking way.

In yet another embodiment, the chin protector comprises polycarbonate, propionate, acetate, polymethylmethacrylate or a combination thereof. Other materials with similar properties are also conceivable. The advantage of these materials is that a chin protector with the required properties such as for example optical properties including optical transmission, reflection etc. and such as for example mechanical properties such as bendability, rigidity, hardness, scratch-resistance, durability, skin-friendliness, shape, in particular according to anatomy needs and without sharp edges etc. can be provided in an easy and cost-efficient way through the use of such materials. Other properties, for example chemical resistance or electrical properties, may be important as well. Here, the abovementioned materials may also show a good behavior.

In one embodiment, the chin protector according to the present disclosure comprises an extruded material. The advantage of such an extruded material is that the chin protector can be provided in an easy and cost-efficient way with the required properties, for example as mentioned above.

In a further embodiment, the chin protector and/or the protective face shield further comprises attachment means wherein the chin protector engages with its attachment means a portion of the protective face shield and/or the protective face shield engages with its attachment means a portion of the chin protector. Preferably, the attachment means of the chin protector and the attachment means of the protective face shield engage with each other. As mentioned above, the attachment of the chin protector to the protective face shield may be releasable, i. e. such that the chin protector can be detached or removed from the protective face shield after attachment, or non-releasable, i. e. such that it cannot be detached or removed once the chin protector has been attached to the protective face shield. Whether the attachment is releasable or non-releasable may also depend on the attachment means used for attachment. Suitable attachment means may include, but not limited to, mechanical attachment means such as pins, groove and tongue, hook and loop, snap-fit, screws, bolts, rivets or other form-fit providing connections. Further attachment means may include e. g. clips, clamps, spring-loaded connection means or other friction connection means. Moreover, attachment means may include adhering, soldering, welding, vulcanizing or other adhesive bond providing means. A preferred attachment means of the chin protector may include protrusions, e. g. pins with a compressible enlarged end portion at the chin protector and a respective receptacle at the protective face shield such as a hole at the protective face shield, wherein the pin engages with the hole to provide for the attachment. A compressible enlarged end portion of the pin may help to release the attachment. The attachment means may preferably comprise a bar, from which the protrusion, preferably the pin protrudes. For attachment, the bar may be bent to some extent so that the protrusion, preferably the pin, is in the right orientation to be engaged with the receptacle. In case of a compressible enlarged portion present at the protrusion, this portion may be compressed and engaged with the receptacle such that the compressed portion releases when engaged thereby achieving a reliable mechanical attachment. It is also conceivable that the attachment means are configured and arranged such that no bending of the attachment means or parts thereof is necessary for attachment. Alternatively, the protective face shield may comprise attachment means comprising a protrusion, preferably a pin protruding from the attachment means, wherein the protrusion is configured and arranged to engage with a receptacle of the chin protector, the protrusion preferably comprises a compressible enlarged portion. Preferably, the attachment means comprises a bar from which the protrusion, preferably the pin, protrudes. Also, combinations of different attachment means are conceivable, e. g. using a pin in a hole together with an adhesive, e. g. if a certain bonding strength is required or if the attachment is to be non-releasable. The way of attachment may also depend on the materials used for the chin protector and the protective face shield. For example, for polymeric materials, in particular thermoplastic materials, welding may work, whereas for other materials, such as metal or glass, different attachment means may be better suitable. As outlined above, the attachment means may protrude planar or with an angle relative to the planar shape from the chin protector. Similarly, the attachment means protrude planarly or with an angle from the protective face shield. The attachment means may protrude from an edge of the chin protector or the protective face shield. Alternatively, the attachment means may protrude from one of the major surfaces of the chin protector or the protective face shield. The attachment means may be integral with the chin protector and/or the protective face shield. Alternatively, the attachment means may be separate parts engageable with the chin protector and/or the protective face shield. In case of separate attachment means, the engagement to the chin protector and/or the protective face shield may be releasable, i. e. the attachment means are detachable after having been engaged with the chin protector and/or the protective face shield. Alternatively, the engagement may be non-releasable, i. e. the attachment means cannot be detached from the chin protector and/or the protective face shield anymore. The advantage of such attachment means is that an easy attachment may be achieved, e. g. with mechanical attachment means, in particular if release of the attachment is required. Also, adhesives or adhesive tapes may be beneficial to provide an easy attachment means, in particular, if neither the chin protector nor the protective face shield has pre-arranged attachment means. Adhesive bond providing attachment means, e. g. like welding, may be advantageous as these typically provide a comparably high bonding strength.

In a further embodiment, the assembly of the protective face shield and the chin protector according to the present disclosure further comprises attachment means. The attachment means of the assembly engages with a portion of the protective face shield wherein the attachment means of the assembly engages with a portion of the chin protector. The attachment means are engageable with and are disengageable from the chin protector and from the protective face shield. Preferably, the attachment means of the assembly engage with the attachment means of the chin protector and/or with the attachment means of the protective face shield. Different to the embodiment, where either the chin protector or the protective face shield comprises attachment means, an assembly having attachment means provides for more freedom of attachment. In other words, such separate attachment means, i. e. separate from the chin protector and from the protective face shield, respectively, allow for more flexibility of attachment because also chin protectors and/or protective face shields not having any attachment means can be used and attached together to form the assembly.

In yet another embodiment, the chin protector of the assembly is arranged such that it abuts with its edge on the inner major surface of the protective face shield at least partially. In other words, the portion of the edge facing towards the inner major surface of the protective face shield abuts at least partially or entirely on the inner major surface of the protective face shield. The advantage of such an arrangement is that no objects like e.g. dust, dirt, small particles or droplets can move beyond the chin protector thereby reaching the wearer's skin. Also, an increased stability may be achieved with a gapless attachment of the chin protector to the protective face shield.

In yet a further embodiment, the chin protector of the assembly is arranged such that a gap is arranged between its edge and the inner major surface of the protective face shield at least along a part of the extension of the edge. In other words, the gap is provided along a portion of the edge facing towards the inner major surface of the protective face shield at least partially or entirely. For example, the gap may have a width in the range of 1 to 20 mm, preferably 1 to 10 mm, more preferred 1 to 5 mm. The advantage of such an arrangement is that the gap may allow for ventilation of the space encapsulated by the chin protector and the protective face shield, respectively. Also, a gap between the chin protector and the protective face shield may provide a higher degree of freedom for the shape(s) of the chin protector and the protective face shield, respectively.

In one embodiment, the protective face shield of the assembly has a substantially semi-circular portion, wherein the radius of the substantially semi-circular portion is larger than the bend radius of the chin protector being in the curved configuration. In other words, the curvature of the edge of the protective face shield is larger than the bending radius of the chin protector. Substantially semi-circular is understood as a portion of the edge of the chin protector being curved such that a portion of the chin protector exhibits a substantially semi-circular or semi-oval shape. The chin protector may be equidistantly spaced inwards from the edge of the face shield. An advantage of such a configuration is that the chin protector is easily attachable to the inner major surface of the protective face shield in such a configuration. Also, ingress of objects like particles or droplets may be decreased thereby. Alternatively, the distance of the chin protector from the edge of the protective face shield may vary over the edge.

In another embodiment, the optical and/or mechanical properties of the chin protector of the assembly are the same as the optical and/or mechanical properties of the protective face shield of the assembly. Preferably, the material of the chin protector is the same as the material of the protective face shield. Required properties of the material for the chin protector may include, for example, optical properties including optical transmission, reflection etc. and also, for example, mechanical properties such as bendability, rigidity, hardness, scratch-resistance, durability, skin-friendliness, shape, in particular according to anatomy needs and without sharp edges etc. These can be provided in an easy and cost-efficient way through the use of such materials. In particular, the optical transmission of the material of the chin protector is the same as for the material of the protective face shield. Other properties, for example chemical resistance or electrical properties, may be important as well. Preferably, also the chemical resistance of the chin protector and the protective face shield is the same. The advantage of having the same properties for the materials for the chin protector and for the protective face shield is that the materials show the same behavior with regard to the required properties as mentioned above. In particular, if the optical transmission is the same for the chin protector as well as for the protective face shield, the good viewing conditions for the wearer are achieved and optical distortion or the like is minimized or avoided, which may occur with different optical properties.

In yet another embodiment, the chin protector of the assembly protrudes substantially perpendicular from the inner major surface of the protective face shield. It is understood that an angle of 75° to 105° measured between a major surface of the chin protector and the inner major surface the protective face shield is considered as being perpendicular to each other. The advantage of such an arrangement is that a stable and comfortable arrangement of the chin protector is achieved thereby, in particular with regard to surrounding the wearer's chin while providing for sufficient protection of the chin and neck, respectively, of the wearer.

In one embodiment, the assembly of a protective helmet and a chin protector also comprises a protective face shield, wherein the chin protector abuts with its edge on the inner major surface of the protective face shield at least partially. The abutment of chin protector may be over a part of the chin protector edge only or over the entire length of the edge facing towards the protective face shield and the inner major surface thereof, respectively. The advantage of such an arrangement is that the ingress of objects like particles or droplets is minimized or avoided thereby. Also, an increased stability may be achieved.

In another embodiment, the assembly of a protective helmet and a chin protector comprises a protective face shield, wherein the chin protector is arranged such that a gap is arranged between its edge and the inner major surface of the protective face shield at least along a part of or entirely along the extension of the edge facing towards the inner major surface of the protective face shield, if present. For example, the gap may have a width in the range of 1 to 20 mm, preferably 1 to 10 mm, more preferred 1 to 5 mm. The advantage of such an arrangement is that ventilation is allowed of the space encapsulated by the chin protector and the protective face shield, respectively. Also, an increased freedom of selection of a chin protector may be achieved.

In a further embodiment, the assembly of a protective helmet and a chin protector further comprises a protective face shield, wherein the chin protector is additionally connected to the protective face shield, preferably by attachment means of the chin protector and/or of the protective face shield. Such a protective face shield is of advantage because an increased protection of a wearer of the assembly is achieved thereby. Also, a protective face shield with such a connection is of advantage because as the mechanical stability may be increased.

In another embodiment, in the method of retrofitting a protective face shield with a chin protector, the chin protector and/or the protective face shield of the assembly further comprises attachment means. The attachment means of the chin protector are engageable with a portion of the chin protector or the attachment means of the protective face shield are engageable with a portion of the chin protector or the attachment means of the chin protector and of the protective face shield are engageable with each other. In use—the chin protector is maintained in a curved configuration thereby surrounding the chin protector of a wearer of the protective face shield. In this embodiment, the step of attaching the chin protector to the protective face shield comprises engaging the attachment means of the chin protector with the protective face shield or engaging the attachment means of the protective face shield with the chin protector or engaging the attachment means of the chin protector and the protective face shield with each other. Examples of such attachment means are outlined above in more detail as well as advantages associated with such attachment means.

The invention was described in various embodiments above. It is understood by a person skilled in the art, that one, several or all of the above-mentioned embodiments can be combined with each other.

The invention will now be described in more detail with reference to the following Figures exemplifying particular embodiments of the invention:

Figure 1B:
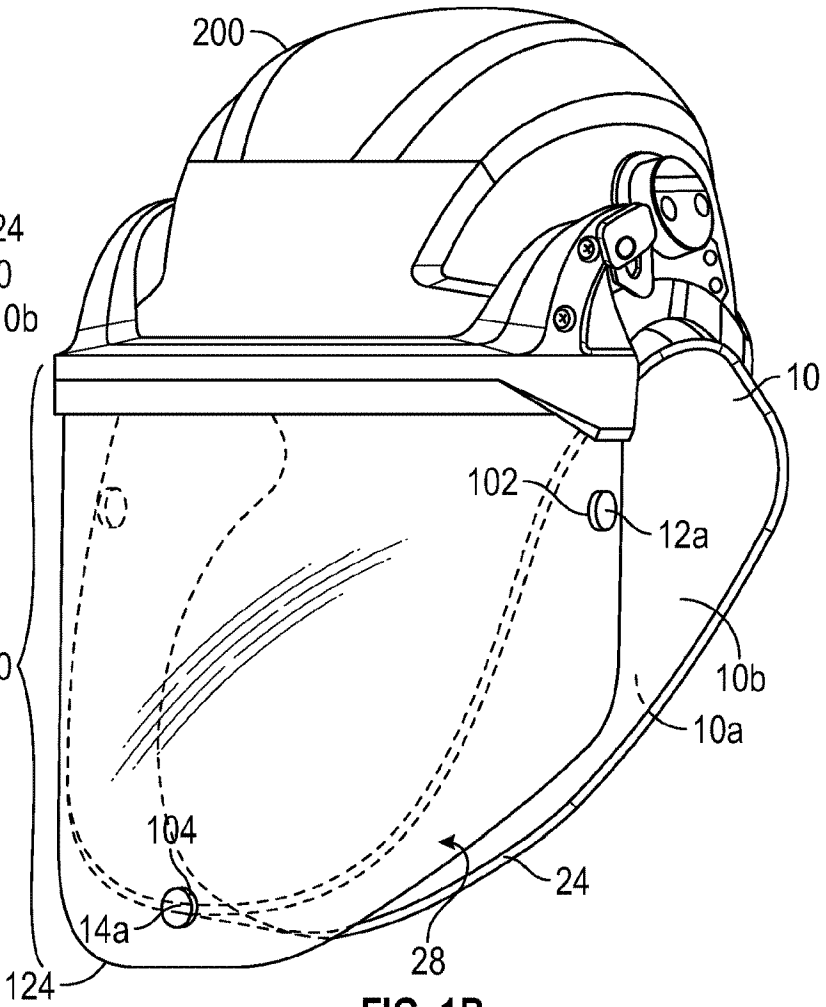
FIG. 1B is a perspective front view of an assembly shown in FIG. 1A, wherein the assembly is attached to a protective helmet.
Figure 1A:
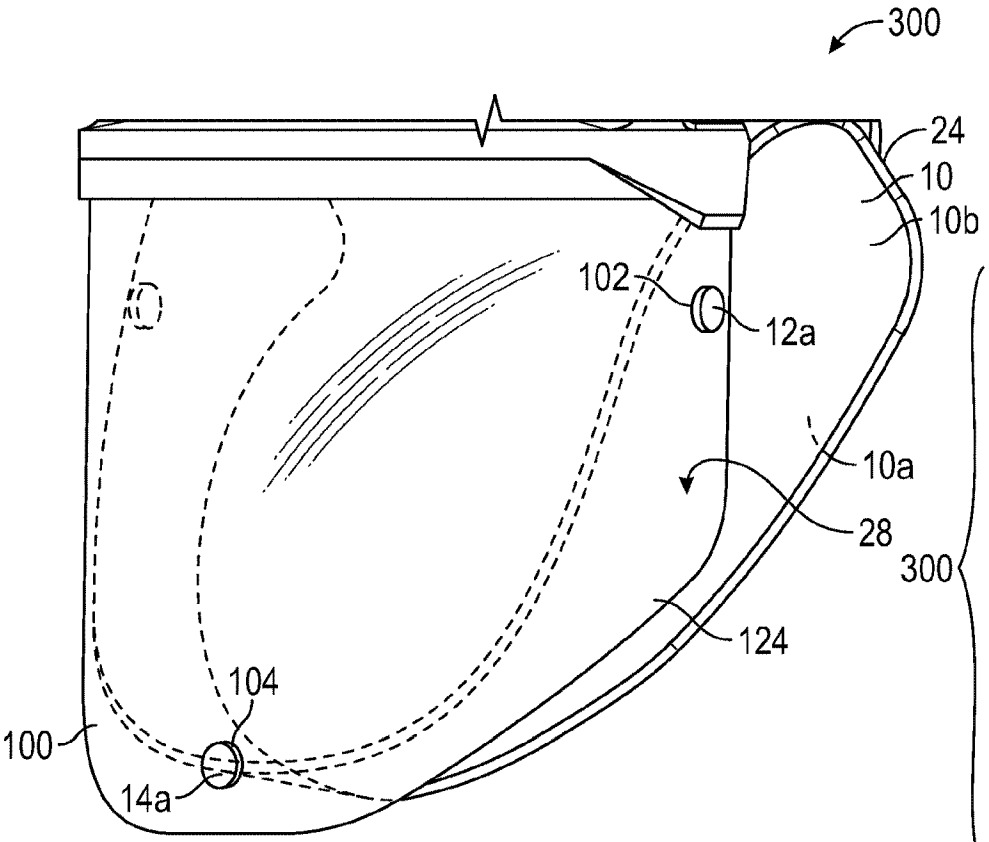
FIG. 1A is a perspective front view of an assembly of a protective face shield and a chin protector according to a first embodiment of the present disclosure.
Figure 3A:
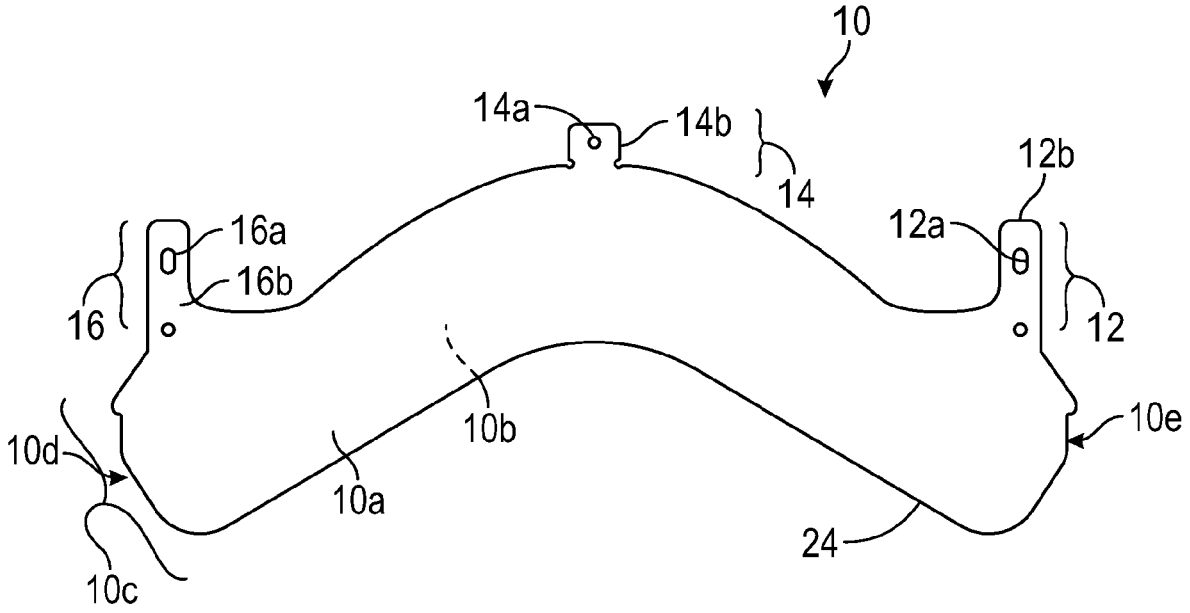
FIG. 3A is a top view of a chin protector according to an embodiment of the present disclosure exhibiting a generally planar configuration.

FIG. 1A shows in a perspective front view an embodiment of the chin protector 10 according to the present disclosure as part of an assembly 300 with a protective face shield 100, i. e. the chin protector 10 and the protective face shield 100 form the assembly 300. The chin protector 10 is shown in an attached stage, i. e. in use, exhibiting a curved configuration. The chin protector 10 comprises an inner and an outer major surface 10A, 10B, an edge 24 and attachment means 12, 14, 16 (only part of which are visible here) comprising the pin-like protrusions or pins 12*a*, 14*a*, 16*a*. In some embodiments, the attachment means 12, 14, 16 comprises a bar 12*b*, 14*b*, 16*b* (not shown here, see FIG. 3A) protruding from the edge of the chin protector, from which the pins 12*a*, 14*a*, 16*a* having an enlarged portion at their ends protrude. The chin protector 10 is attached to a protective face shield 100 via pins 12*a*, 14*a*, 16*a* engaging with the attachment means 102, 104, 106 of the protective face shield 100, which are formed as receptacles or holes in the embodiment shown. The chin protector 10 is kept in its curved configuration thereby. More details of the attachment means 12, 14, 16 according to an embodiment of such assembly are shown in FIG. 3A. The protective face shield 100 comprises an inner and an outer major surface 26, 28 and an edge 124. As can be seen from FIG. 1A, the chin protector 10 is attached to the inner major surface 26 of the protective face shield 100. The protective face shield 100 also has a curved shape as illustrated in FIG. 1A, wherein the side portions of the protective face shield 100 are bent rearwards, i. e. towards the chin protector 10 such that the inner major surface 26 of the protective face shield 100 and the outer major surface 10B (i. e. the one facing towards the protective face shield 100) of the chin protector 10 are close to each other or are even in contact with each other. This enables or simplifies the attachment means 12, 14, 16 of the chin protector 10 to engage with the attachment means 102, 104, 106 of the protective face shield 100. Other configurations are conceivable, i. e. where the protective face shield has no such curved portions. The inner major surface 26 of the protective face shield 100 faces towards a wearer 500 (not shown here, see FIG. 12) of the assembly 300. In use, the chin protector 10 in its curved configuration surrounds the chin 510 of a wearer 500 (both not shown here, see FIG. 12). In the embodiment shown, the chin protector 10 does not extend beyond the edge 124 of the protective face shield 100, which is indicated by a dotted line to illustrate where the edge 24 of the chin protector 10 is arranged (behind the protective face shield 100).

FIG. 1B shows in a perspective front view the assembly 300 as shown in FIG. 1A and as described above. In addition, FIG. 1B shows a protective helmet 200. The protective face shield 100 and the assembly 300, respectively, are attached to the protective helmet 200 by attachment means, for example through a pivotal attachment means of the protective helmet 200. Such an attachment means may—together with a lever—allow for a pivotal movement to lift the protective face shield 100 and the chin protector 10 connected therewith. The chin protector 10 may, in addition to what is shown here, also be attached to the protective helmet 200 by attachment means 214, 216, 218 (not shown in FIG. 1, see FIGS. 9A and 9B), which may disengage or otherwise be configured such that a pivotal movement of the protective face shield 100 and the chin protector 10, respectively, is still allowed.

Figure 2B:
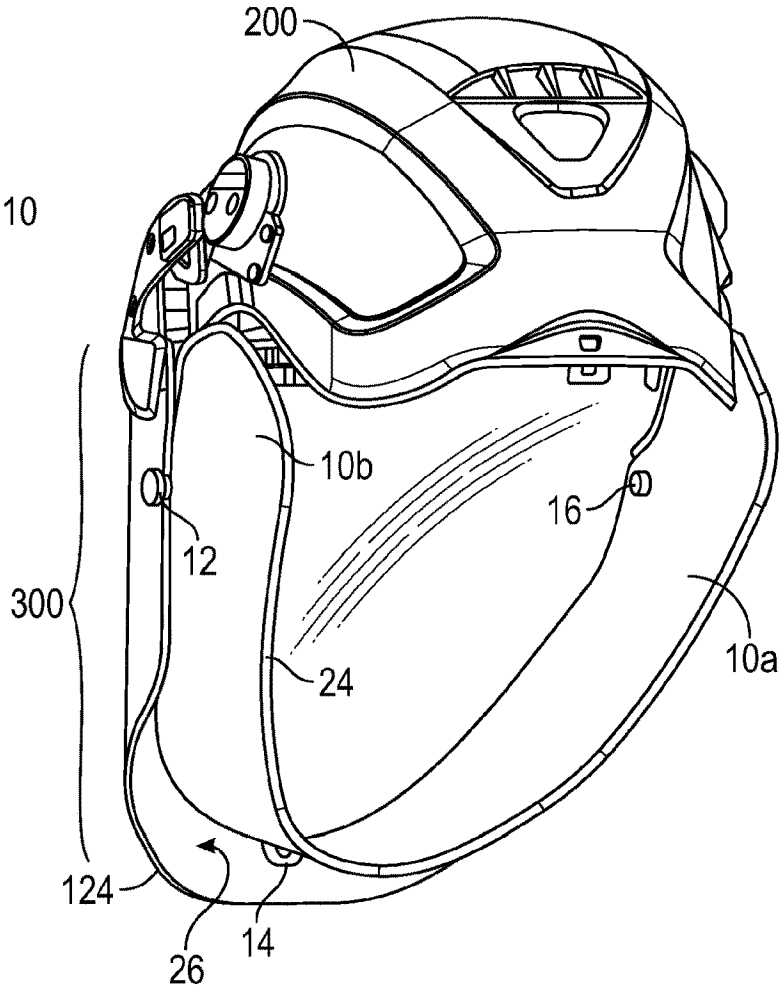
FIG. 2B is a perspective rear view of the assembly of FIG. 1B, wherein the assembly is attached to a protective helmet.
Figure 2A:
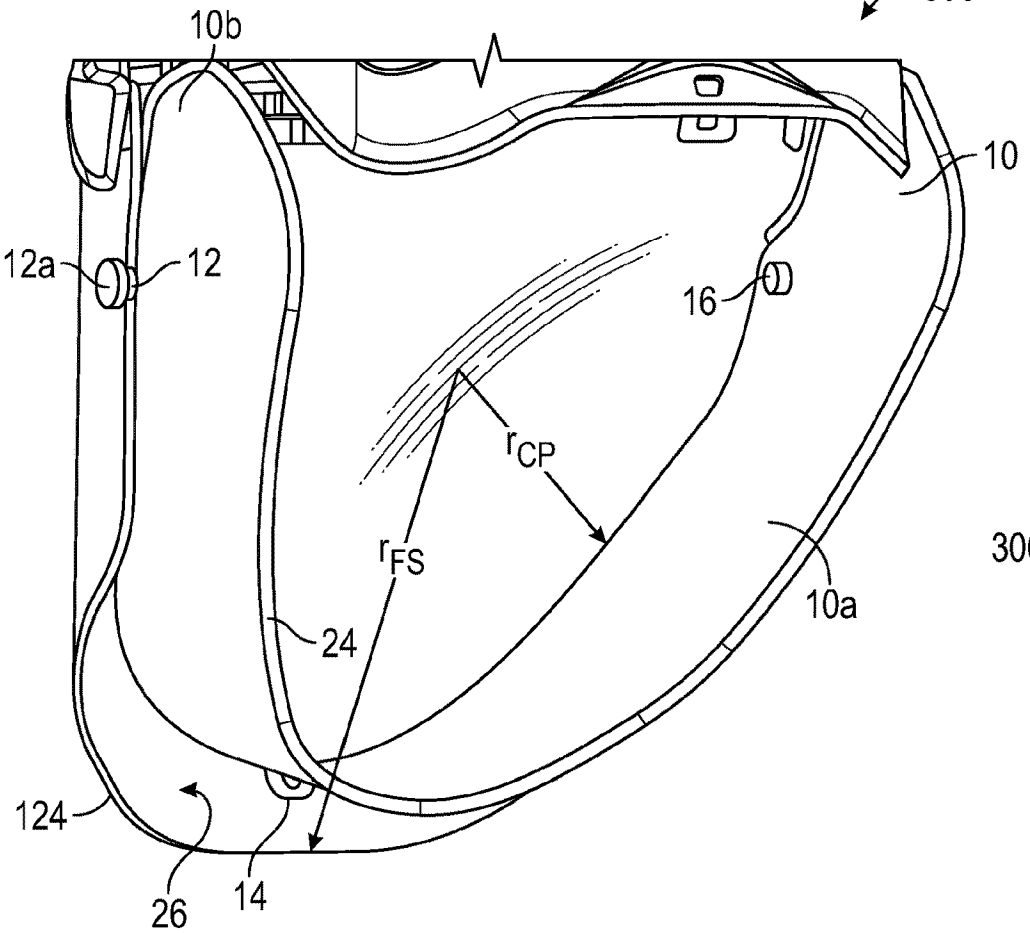
FIG. 2A is a perspective rear view of the assembly of FIG. 1A.

FIGS. 2A and 2B show the assembly 300 as shown in FIGS. 1A and 1B in a rear perspective view, wherein FIG. 2A shows the assembly 300 formed by the chin protector 10 and the protective face shield 100 (similarly to FIG. 1A) and wherein FIG. 2B shows the assembly 300 connected to a protective helmet 200 (similarly to FIG. 1B). As can be seen in FIG. 2A, the chin protector 10 is attached in its curved configuration to the protective face shield 100 through the attachment means 12, 14, 16 of the chin protector 10 with the pin-like protrusions or pins 12*a*, 14*a*, 16*a*. In some embodiments, the attachment means 12, 14, 16 comprises a bar 12*b*, 14*b*, 16*b* (not visible here, see FIG. 3A) and pins 12*a*, 14*a*, 16*a* with an enlarged end portion. In FIG. 2A, only pin 12*a* with its enlarged end portion is visible. As can further be seen, the attachment means 12, 14, 16 in the embodiment shown protrude from the outer major surface 10B of the chin protector 10 which faces towards the inner major surface 26 of the protective face shield 100. More details of the attachment means 12, 14, 16 are shown in FIG. 3A. In the embodiment shown, the protective face shield 100 also comprises curved portions, which are bent towards the chin protector 10 such that the inner major surface 26, i. e. the major surface facing—in use—towards a wearer (not shown here) of the assembly 300, of the protective face shield 100 and the outer major surface 10B (i. e. the one facing towards the protective face shield 100) of the chin protector 10 are close to each other or are even in contact with each other. The chin protector 10 is maintained in its curved configuration because of the attachment to the protective face shield 100 through the attachment means 12, 14, 16 of the chin protector 10. The inner major surface 10A of the chin protector 10 faces in this curved configuration—in use—towards the face 520, in particular the chin 510, of a wearer 500 (not shown here, see FIG. 12) and thereby surrounds the chin 510 of the wearer 500. As can further be seen in FIG. 2A, the chin protector 10 exhibits—in its curved configuration—a bending radius $r_{CP}$. The protective face shield 100 comprises at its lower end a substantially semi-circular portion exhibiting a radius us. The upper portion of the protective face shield is rather rectangularly shaped. It is apparent from FIG. 2A, that the bending radius $r_{CP}$ of the chin protector 10 is smaller than the radius $r_{FS}$ of the curved portion of the protective face shield 100. Thereby, the chin protector 10 in its curved configuration does not extend beyond the edge 124 of the protective face shield 100 so that either the chin protector 10 is in contact with its edge 24 with the inner major surface 26 of the protective face shield 100 or a small gap only is provided between the edge 24 of the chin protector 10 and the inner major surface 26 of the protective face shield 100. Although such an arrangement is preferred, other configurations, e. g. with a rather large gap between the edge 24 of the chin protector 10 and the inner major surface 26 of the protective face shield 100 or where the bending radius $r_{CP}$ is larger than the radius $r_{FS}$ of the curved portion of the protective face shield 100 such that the chin protector in its curved configuration extends beyond the edge 124 of the protective face shield 100, are conceivable.

FIG. 2B shows—similarly to FIG. 1B—the assembly 300 being attached to a protective helmet 200. As mentioned above for FIG. 1B, attachment means, e. g. pivotal attachment means, are present to attach the assembly 300, in particular the protective face shield 100, to the protective helmet 200 such that lifting of the protective face shield 100 and the assembly 300, respectively, is allowed. The chin protector 10 may, in addition to what is shown here, also be attached to the protective helmet 200 by attachment means 214, 216, 218 (not shown in FIG. 2B, see FIGS. 9A and 9B).

FIG. 3A shows in a top view the chin protector 10 according to an embodiment of the present disclosure. The chin protector 10 exhibits a generally planar configuration when not in use, i. e. prior to and/or after use. The chin protector 10 comprises an inner and an outer major surface 10A, 10B (only one of which, i. e. the inner major surface 10A, is visible here) and an edge 24. The chin protector 10 further comprises two opposite ends 10D, 10E and a main portion 10C, from which attachment means 12, 14, 16 protrude generally planarly, i. e. being generally in the same plane as the main portion 10C of the chin protector 10. In the embodiment shown, the chin protector 10 comprises three attachment means 12, 14, 16, two of which are located towards the ends 10D, 10E of the chin protector 10 and one of which is located in the middle. As can be seen from FIG. 3A, the attachment means 12, 14, 16 each comprise a bar 12*b*, 14*b*, 16*b* connected to and protruding from the main portion 10C of the chin protector 10 and each comprise a pin-like protrusion or pin 12*a*, 14*a*, 16*a* for engaging with respective attachment means, i. e. receptacles or holes 102, 104, 106 of the protective face shield 100 (not shown here). The pin-like protrusions or pins 12*a*, 14*a*, 16*a* each have a compressible enlarged portion for engagement with the receptacles or holes 102, 104, 106 (both of which is not shown here).

Figure 3B:
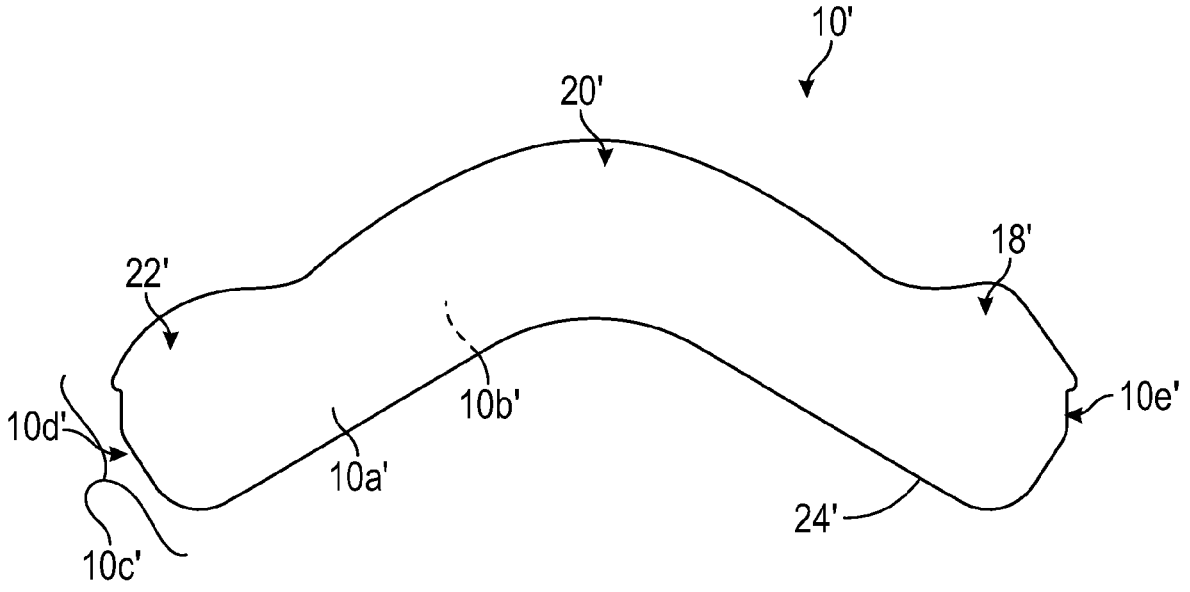
FIG. 3B is a top view of a chin protector according to another embodiment of the present disclosure exhibiting a generally planar configuration.

FIG. 3B shows in a top view the chin protector 10' according to another embodiment of the present disclosure. The chin protector 10' also exhibits a generally planar configuration when not in use, i. e. prior to and/or after use. The chin protector 10' comprises an inner and an outer major surface 10A', 10B' (only one of which, i. e. the inner major surface 10A' is visible here) and an edge 24'. The chin protector 10' further comprises two opposite ends 10D', 10E' and a main portion 10C'. The difference to the embodiment of the chin protector 10 as shown in FIG. 3A is that here, no attachment means are arranged at the chin protector 10'. Instead, the chin protector 10' comprises three portions 18', 20', 22' of engagement which are engageable by attachment means being separate from the chin protector 10'. Two attachment portions 18', 22' are located towards the ends 10D', 10E' of the chin protector 10' and one attachment portion 20' is located in the middle of the main portion 10C' of the chin protector 10' such that an engagement by the separate attachment means is facilitated. The separate attachment means are not shown here, see FIGS. 4A-5B for this.

Figure 4B:
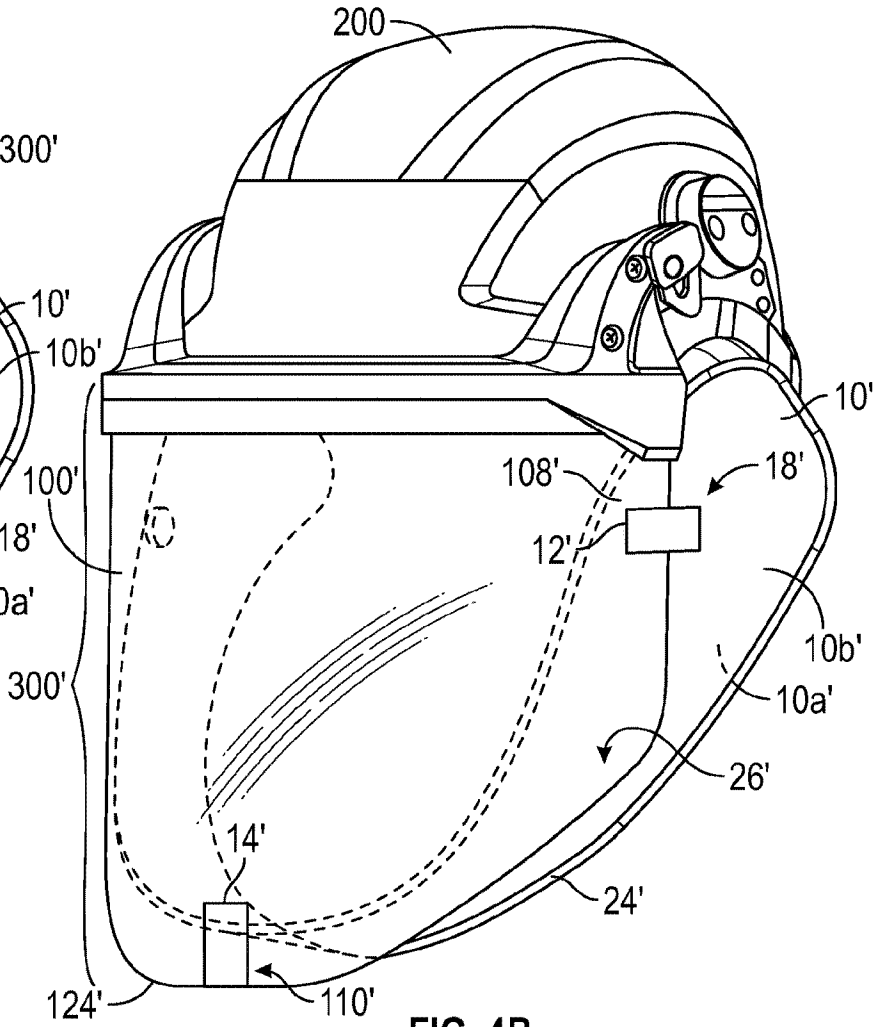
FIG. 4B is a perspective front view of an assembly shown in FIG. 4A, wherein the assembly is attached to a protective helmet.
Figure 4A:
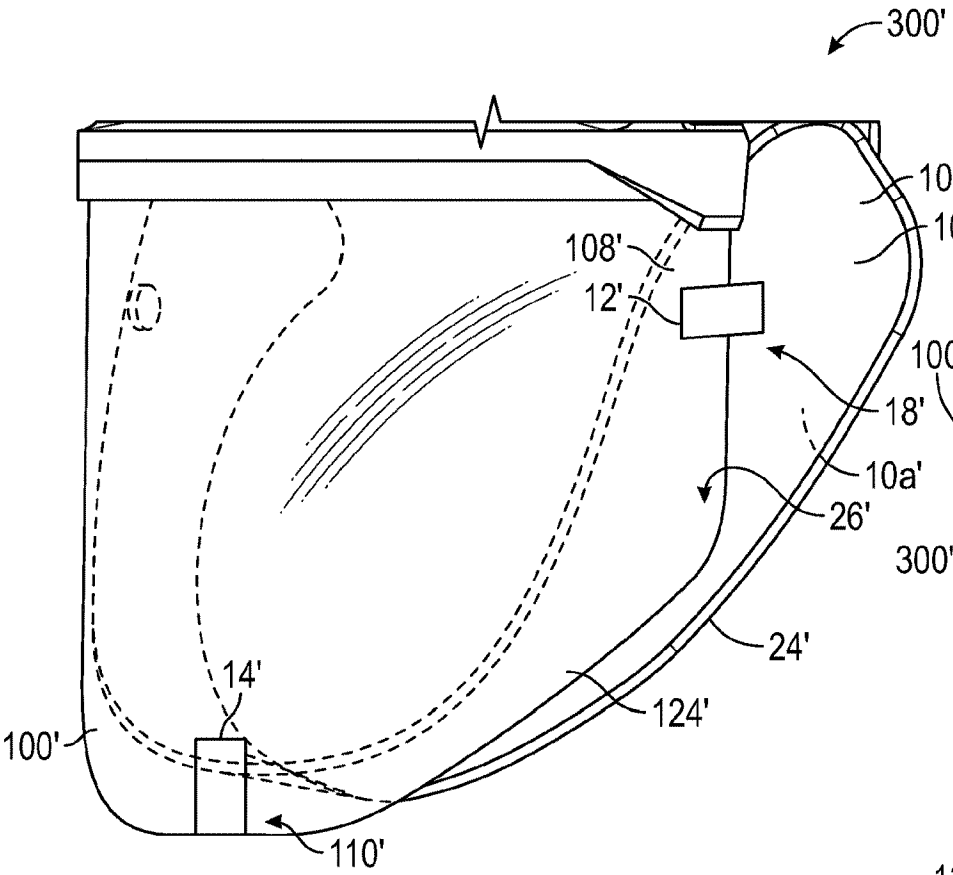
FIG. 4A is a perspective front view of an assembly of a protective face shield and a chin protector according to another embodiment of the present disclosure

FIG. 4A shows in a perspective front view a different embodiment of the chin protector 10' according to the present disclosure as part of an assembly 300' with a protective face shield 100', i. e. the chin protector 10' and the protective face shield 100' form the assembly 300'. The chin protector 10' is shown in the attached stage, i. e. in use, exhibiting a curved configuration. The chin protector 10' comprises—similar to the embodiment of FIG. 1A—two opposite major surfaces 10A', 10B', an edge 24'. Different to FIG. 1A, the chin protector 10' is attached with different attachment means 12', 14', 16'. In the embodiment shown, the attachment means 12', 14', 16' are not part of the chin protector 10' or the protective face shield 100', but they are separate parts engaging with a portion 18', 20', 22' (only 18' is indicated here) of the chin protector 10' on the one hand and on the other hand engaging with a portion 108', 110', 112' (only 108', 110' are indicated here) of the protective face shield 100'. The chin protector 10' is kept in its curved configuration thereby. The protective face shield 100' comprises an inner and an outer major surface 26', 28' and an edge 124'. As can be seen from FIG. 4A, the chin protector 10' is attached to the inner major surface 26' of the protective face shield 100'. The protective face shield 100' also has a curved shape as illustrated in FIG. 4A, wherein the side portions of the protective face shield 100' are bent rearwards, i. e. towards the chin protector 10' such that the inner major surface 26' of the protective face shield 100' and the outer major surface 10B' (i. e. the one facing towards the protective face shield 100') of the chin protector 10' are close to each other or are even in contact with each other. This enables the attachment means 12', 14', 16' to better engage with the attachment portions 18', 20', 22' of the chin protector 10' and with the attachment portions 108', 110', 112' of the protective face shield 100'. Although such an arrangement is preferred, other configurations, e. g. without curved portions of the protective face shield 100', are conceivable. The chin protector 10' and the protective face shield 100' form the assembly 300'. The inner major surface 26' of the protective face shield 100' faces towards a wearer 500 (not shown here, see FIG. 12) of the assembly 300'. In use, the chin protector 10' in its curved configuration surrounds the chin 510 of a wearer 500 (both not shown here, see FIG. 12). In the embodiment shown, the chin protector 10' does not extend beyond the edge 124' of the protective face shield 100', which is indicated by a dotted line to illustrate where the edge 24' of the chin protector 10' is arranged (behind the protective face shield 100').

FIG. 4B shows in a perspective front view the assembly 300' as shown in FIG. 4A and as described above. In addition, FIG. 4B shows a protective helmet 200. The protective face shield 100' and the assembly 300', respectively, are attached to the protective helmet 200 by attachment means, for example through a pivotal attachment means of the protective helmet 200. Such an attachment means may—together with a lever—allow for a pivotal movement to lift the protective face shield 100' and the chin protector 10' connected therewith. The chin protector 10' may, in addition to what is shown here, also be attached to the protective helmet 200 by attachment means 214, 216, 218 (not shown in FIG. 4B, see FIGS. 9A and 9B).

Figure 5B:
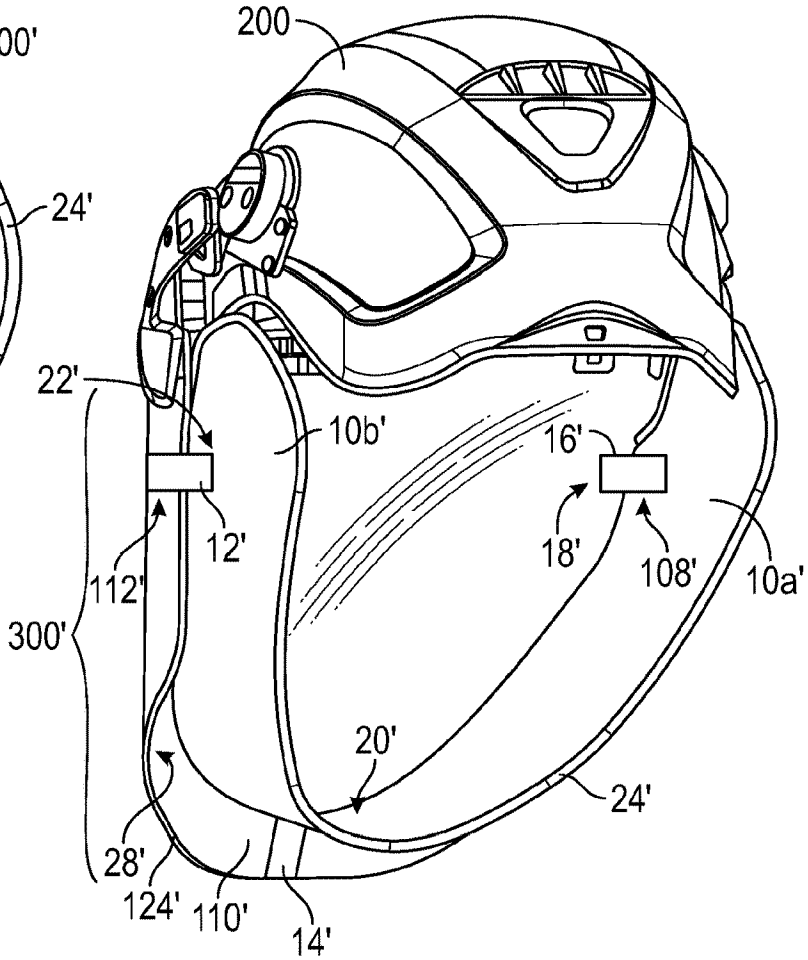
FIG. 5B is a perspective rear view of the assembly of FIG. 4B, wherein the assembly is attached to a protective helmet.
Figure 5A:
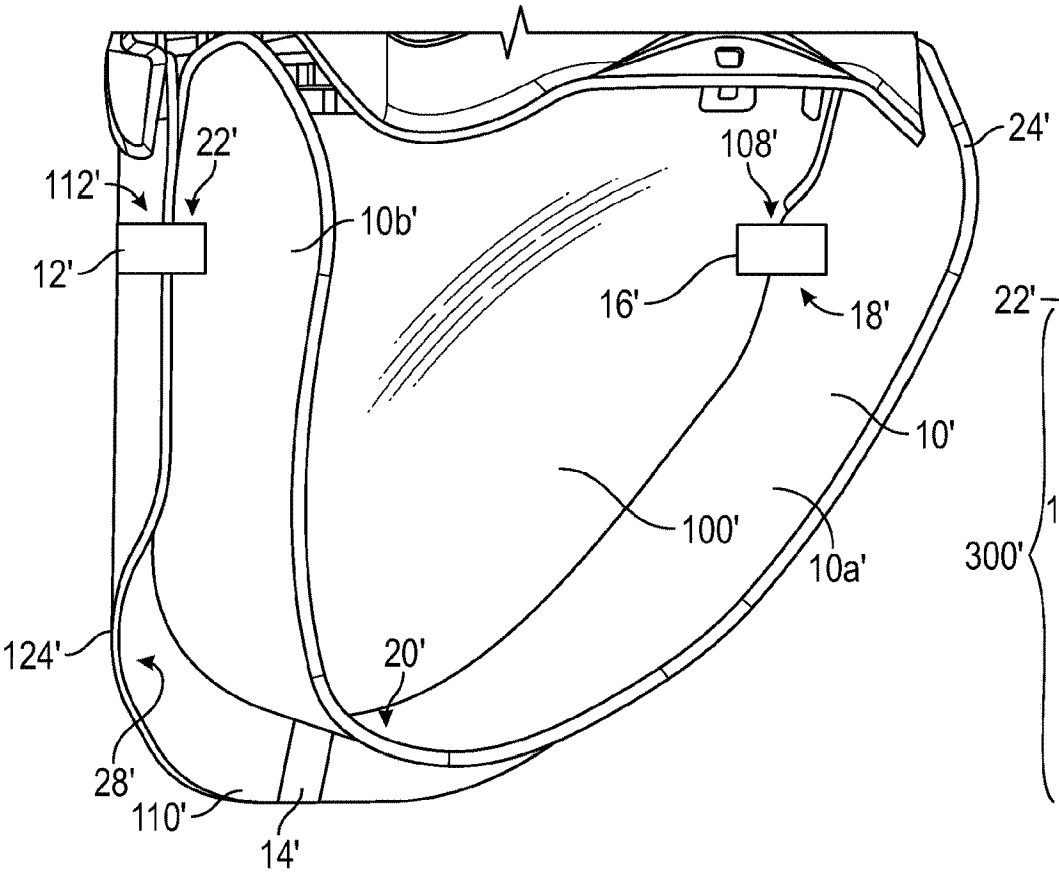
FIG. 5A is a perspective rear view of the assembly of FIG. 4A.
Figure 8:
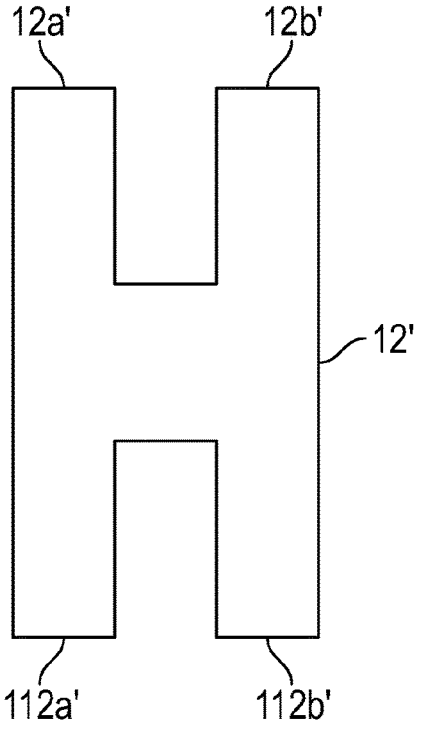
FIG. 8 is a partially cut away schematic top view of an attachment means according to another embodiment of the chin protector.

FIGS. 5A and 5B show the assembly 300' as shown in FIGS. 4A and 5B in a rear perspective view, wherein FIG. 5A shows the assembly 300' of a chin protector 10' and a protective face shield 100' (similarly to FIG. 1A or 4A), whereas FIG. 2B shows the assembly 300' connected to a protective helmet 200 (similarly to FIG. 1B or 4B). As can be seen in FIG. 5A, the chin protector 10' is attached in its curved configuration to the protective face shield 100' through the separate attachment means 12', 14', 16'. The attachment means 12', 14', 16' engage with a portion 18', 20', 22' (only 18' is indicated here) of the chin protector 10' on the one hand and on the other hand engage with a portion 108', 110', 112'. Details of the attachment means 12", 14", 16" are shown in FIG. 8. In the embodiment shown, the protective face shield 100' also comprises curved portions, which are bent towards the chin protector 10' such that the inner major surface 26', i. e. the major surface facing—in use—towards a wearer 500 (not shown here) of the assembly 300', and the outer major surface 10B' (i. e. the one facing towards the protective face shield 100') of the chin protector 10' are close to each other or are even in contact with each other. In use, the chin protector 10' in its curved configuration surrounds the chin 510 of a wearer 500 (both not shown here, see FIG. 12). As outlined above under FIGS. 4A, 4B, the curved portions facilitate a better engagement by the attachment means 12', 14', 16' between the chin protector 10' and the protective face shield 100'. The chin protector 10' is maintained in its curved configuration because of the attachment to the protective face shield 100' through the attachment means 12', 14', 16' of the chin protector 10'. The inner major surface 10A' of the chin protector 10' faces in this curved configuration—in use—towards the face, in particular the chin, of a wearer (not shown here). As shown in FIGS. 5A, 5B, the chin protector 10' in its curved configuration does not extend beyond the protective face shield 100' so that either the chin protector 10' is in contact with its edge 24' with the inner major surface 26' of the protective face shield 100' or a small gap only is provided between the edge 24' of the chin protector 10' and the inner major surface 26' of the protective face shield 100'. Although such an arrangement is preferred, other configurations, e. g. with a rather large gap between the edge 24' of the chin protector 10' and the inner major surface 26' of the protective face shield 100', or where the chin protector 10' extends in its curved configuration beyond the edge 124' of the protective face shield 124', are conceivable.

FIG. 5B shows—similarly to FIG. 4B—the assembly 300' being attached to a protective helmet 200. As mentioned above for FIG. 4B, attachment means, e. g. pivotal attachment means, are present to attach the assembly 300', in particular the protective face shield 100', to the protective helmet 200 such that lifting of the protective face shield 100' and the assembly 300', respectively, is allowed. As mentioned above for FIG. 4B, the chin protector 10' may, in addition to what is shown here, also be attached to the protective helmet 200 by attachment means 214, 216, 218 (not shown in FIG. 5B, see FIGS. 9A and 9B).

Figure 6:
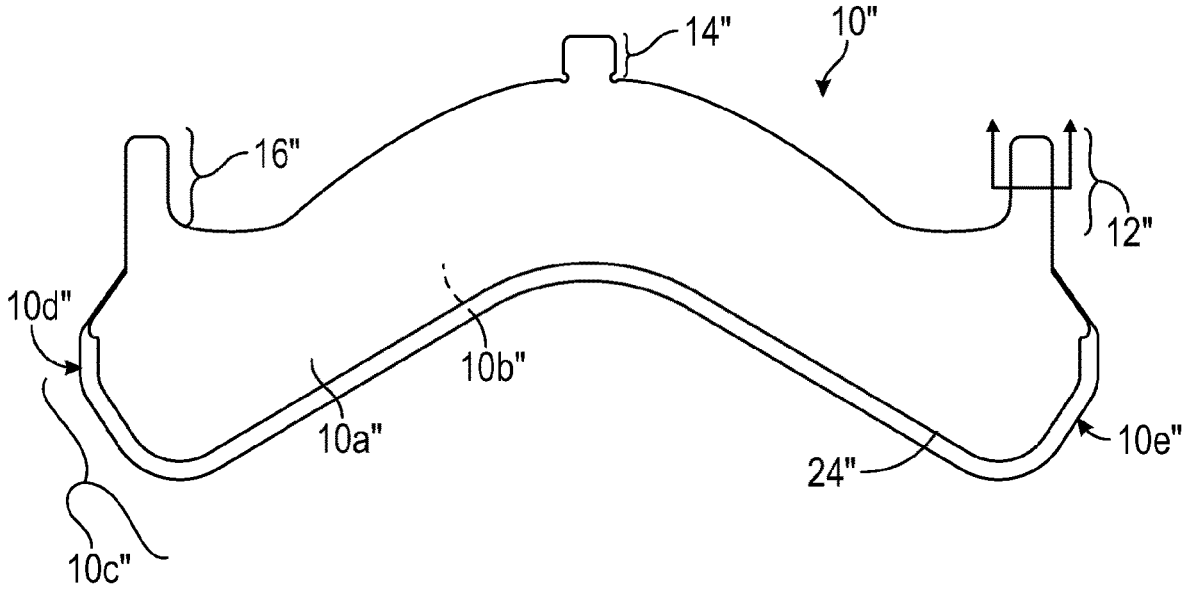
FIG. 6 is a top view of a chin protector according to another embodiment of the present disclosure exhibiting a generally planar configuration.

FIG. 6 shows in a top view the chin protector 10" according to an embodiment of the present disclosure. The chin protector 10" exhibits a generally planar configuration when not in use, i. e. prior to or after use. The chin protector 10" comprises an inner and an outer major surface 10A", 10B" (only one of which, i. e. the inner major surface 10A" is visible here) and an edge 24'. The chin protector 10" further comprises two opposite ends 10"D, 10"E and a main portion 10"C, from which attachment means 12", 14", 16" protrude generally planarly, i. e. being generally in the same plane as the main portion 10C" of the chin protector 10". In the embodiment shown, the chin protector 10" comprises three attachment means 12", 14", 16", two of which are located towards the ends 10D", 10E" of the chin protector 10" and one of which is located in the middle. Details of the attachment means 12", 14", 16" are shown in and described under FIG. 7.

Figure 7:
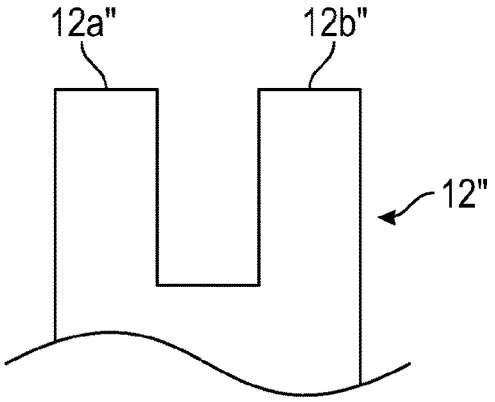
FIG. 7 is a partially cut away schematic top view of an attachment means of the embodiment of the chin protector as shown in FIG. 6.

FIG. 7 shows in a partial cut away schematic top view the attachment means 12", 14", 16" of one embodiment according to the present disclosure (only attachment means 12" is exemplarily shown, the similarly constructed attachment means 14", 16" are omitted). Here, the attachment means 12" is part of the chin protector 10", i. e. these may be integrally formed with and are fixedly attached to the chin protector 10". On one end, opposite to where the attachment means 12" is connected to the chin protector 10", the attachment means 12" comprises protrusions or engagement portions 12*a*", 12*b*" which are engageable with a portion 108" of the protective face shield 100" (both not shown here). In the embodiment shown, the protrusions or engagement portions 12*a*", 12*b*" may clamp the portion 108" of the protective face shield 100' (not shown here) therebetween. The same constructional details are present for attachment means 14" and 16".

FIG. 8 shows in a schematic top view the attachment means 12' of a different embodiment according to the present disclosure (only attachment means 12' is exemplarily shown, the similarly constructed attachment means 14', 16' are omitted). The attachment means 12' comprises—similar to the attachment means 12" as shown in FIG. 7—the protrusions or engagement portions 12*a*', 12*b*' for engagement with a portion 108' of the protective face shield 100' (both not shown here). Different to the attachment means 12" of FIG. 7, the attachment means 12' as shown here further comprises protrusions or engagement portions 112*a*', 112*b*' for engagement with a portion 108' of the chin protector 10' (both not shown here). Consequently, the attachment means 12' is not part of the chin protector 10', but is a separate part attachable with the chin protector 10' and engageable with a portion 18' of the chin protector 10', respectively. Such an arrangement provides for more freedom of attachment between the chin protector 10' and the protective face shield 100' compared to attachment means which are connected to the chin protector. In the embodiment shown, the protrusions 12*a*', 12*b*' on the one hand are configured to engage with, preferably to clamp, a portion 108' of the protective face shield 100', whereas the protrusions or engagement portions 112*a*', 112*b*', on the other hand are configured to engage with, preferably to clamp, a portion 18' of the chin protector 10'. The same constructional details are present for attachment means 14' and 16'.

Figure 9B:
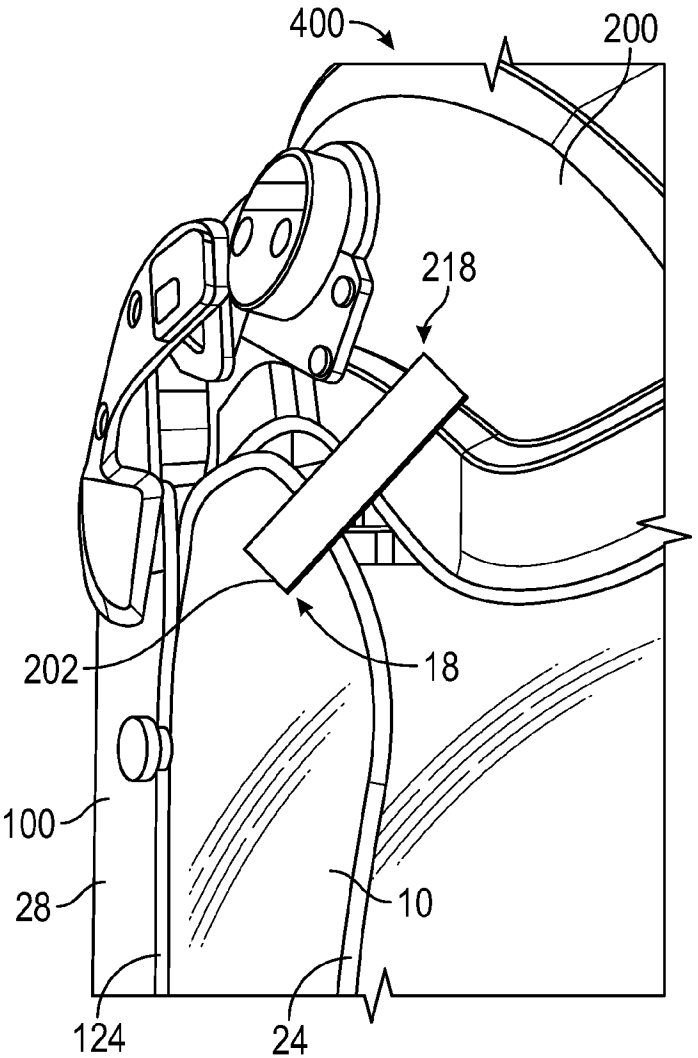
FIG. 9B is a detailed perspective rear view of the assembly as shown in FIG. 9A.
Figure 9A:
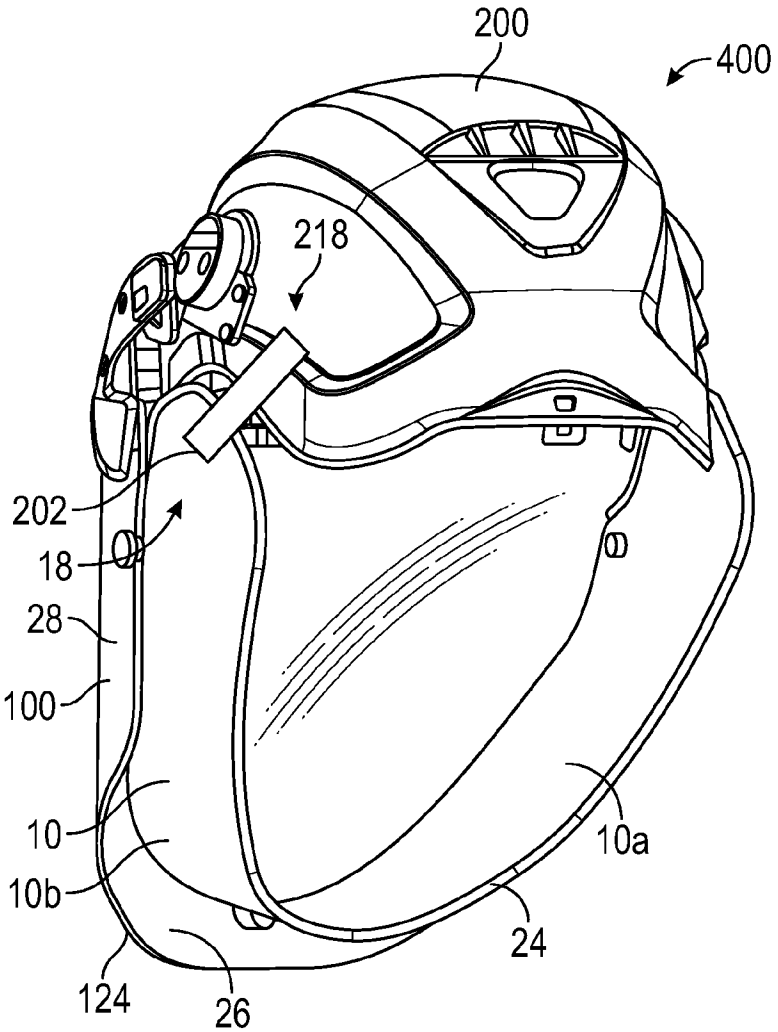
FIG. 9A is a perspective rear view of an assembly of a protective helmet and a chin protector according to another embodiment of the present disclosure, wherein the assembly further comprises a protective face shield.
Figure 10:
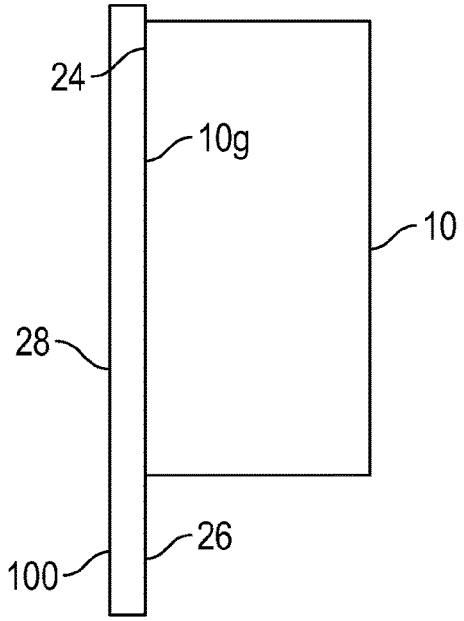
FIG. 10 is a schematic partial side view of a detail of an assembly of a chin protector and a protective face shield according to an embodiment of the present disclosure.
Figure 11:
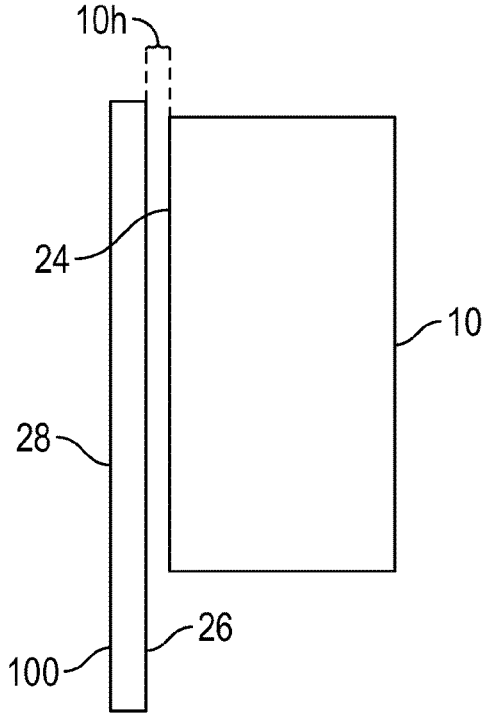
FIG. 11 is a schematic partial side view of a detail of an assembly of a chin protector and a protective face shield according to another embodiment of the present disclosure.

FIGS. 9A and 9B show in a perspective rear view an assembly 400 of a chin protector 10 attached to a protective helmet 200, i. e. the chin protector 10 and the protective helmet 200 form the assembly 400. Similar to the embodiments of the chin protector 10 as described above, the chin protector 10 is in a curved configuration. The chin protector 10 is attached to the protective helmet 200 by the attachment means 202, which engages with a portion 18 of the chin protector 10 on the one hand and which engages with a portion 218 of the protective helmet 200 on the other hand. The chin protector 10 is maintained in its curved configuration thereby. In such a configuration, i. e. in use, the chin protector 10 surrounds the chin 510 of a wearer 500 (both not shown here, see FIG. 12). The assembly 400 may further comprise a protective face shield 100, wherein the chin protector 10 of the assembly 400 may also be attached to the protective face shield 100 in addition to being attached to the protective helmet 200. Alternatively, the chin protector 10 may not be attached to a protective face shield 100 present in such an assembly. As outlined above, the protective face shield 100 has an inner major surface 26 which faces—in use—towards the face 520 of a wearer 500 (both not shown here) and an outer major surface 28 facing—in use—away from the wearer's face 520. The protective face shield 100 as shown here also comprises curved portions being bent towards the chin protector 10, e. g. for achieving a better engagement between these as described above. The protective face shield 100 further comprises an edge 124. The chin protector 10 comprises an inner major surface 10A, which face—in use—towards the chin 510 and/or face 520 of a wearer 500 (not shown here, see FIG. 12), as well as an outer major surface 10B facing—in use—away from a wearer's chin 510 and/or face 520. The chin protector 10 also comprises an edge 24. In the embodiment shown, the chin protector 10 in its curved configuration does not extend beyond the edge 124 of the protective face shield 100. Other configurations, e. g. that the chin protector 10 ins its curved configuration extends beyond the edge 124 of the protective face shield, are conceivable. The chin protector 10 may be arranged such that the edge 24 of the chin protector 10 abuts on the inner major surface 26 of the protective face shield 100 as least partially along the edge 24 facing towards the inner major surface 26 of the protective face shield 100. It is also conceivable that the chin protector 10 is arranged such that a gap is provided between the edge 24 of the chin protector 10 and the inner major surface 26 of the protective face shield 100 at least partially along the edge 24 facing towards the inner major surface 26 of the protective face shield 100. Such arrangements, i. e. with abutment or with a gap, are illustrated in FIGS. 10 and 11 below. In the embodiment shown, the protective face shield 100 also comprises a curved portion, which is bent towards the chin protector 10 such that the inner major surface 26, i. e. the major surface facing—in use—towards a wearer (not shown here) of the assembly 300, of the protective face shield 100 and the outer major surface 10B (i. e. the one facing towards the protective face shield 100) of the chin protector 10 are close to each other or are even in contact with each other.

FIGS. 10 and 11 show in a schematic partial side view details of the chin protector 10 and the protective face shield 100 when in use, i. e. when the chin protector 10 is attached to the protective face shield 100. In FIG. 10, the chin protector 10 abuts on its edge 24 with the inner major surface 26 of the protective face shield 100. The abutment is indicated with an abutment line 10G. The abutment may be only partial, i. e. not the entire portion of the edge 24 facing the inner major surface 26 of the protective face shield 100 of the chin protector 10 abuts on the inner major surface 26 of the protective face shield 100, or entirely, i.e the edge 24 of the chin protector 10 abuts on the inner major surface 26 of the protective face shield 100 over the entire portion facing towards the inner major surface 26 of the protective face shield 100. In contrast thereto, FIG. 11 shows a gap between the edge 24 of the chin protector 10 and the inner major surface 26 of the protective face shield 100. The gap is indicated with reference numeral 10H. The gap 10H may be only partial, i.e. not the entire portion of the edge 24 of the chin protector 10 facing the inner major surface 26 of the protective face shield 100 exhibits a gap to the inner major surface 26 of the protective face shield 100, or entirely, i. e. the edge 24 of the chin protector 10 exhibits a gap to the inner major surface 26 of the protective face shield 100 over the entire portion of the edge 24 facing towards the inner major surface 26 of the protective face shield 100.

Although such arrangements are shown and described for the chin protector 10 and the protective face shield 100, respectively, it is also conceivable to have an abutment or a gap arranged for the embodiments of the chin protector 10', 10" and the protective face shield 100', respectively, of other embodiments according to the present disclosure.

Figure 12:
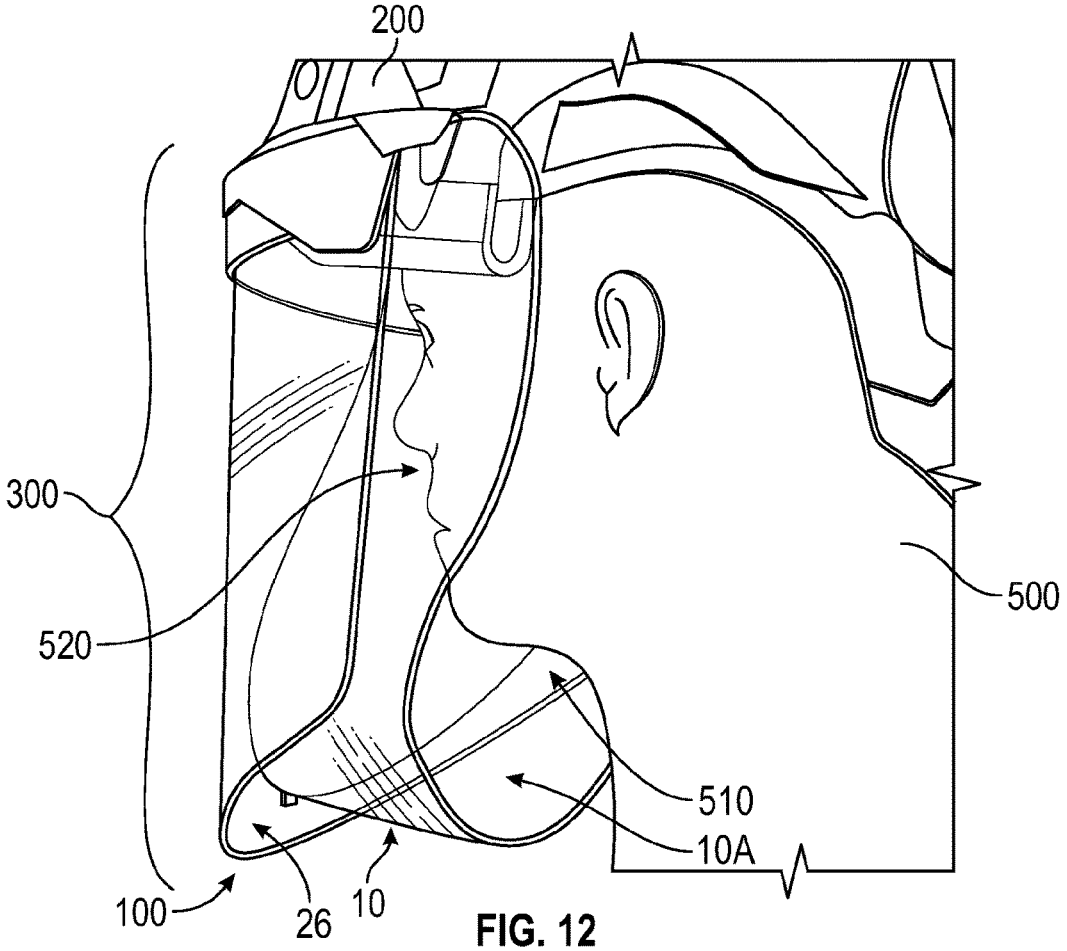
FIG. 12 is a perspective rear view of an assembly of a chin protector and a protective face shield according to an embodiment of the present disclosure worn by a wearer, wherein the assembly is attached to a protective helmet.

FIG. 12 shows in a perspective rear view the assembly 300 of the chin protector 10 and the protective face shield 100. The assembly 300 as shown here is attached to a protective helmet 200, e. g. by pivotal attachment means as shown and described above. FIG. 12 illustrates a wearer 500 of the assembly 300 and the protective helmet 200, respectively. The inner surface 26 of the protective face shield 100 faces towards the face 520 and the chin 510, respectively, of the wearer 500 and the inner major surface 10A of the chin protector 10 faces towards the chin 510 and the face 520, respectively, of the wearer 500. Consequently, when worn, the chin protector 10 of the assembly 300 surrounds the chin 510 of the wearer 500 thereby providing protection of the wearer's chin 510 and face 520 from ingress of dust, dirt, droplets or other moving objects or particles, in particular from a direction coming from below. FIG. 12 exemplarily illustrates the chin protector 10, the protective face shield 100 and the assembly 300. It is clear to the skilled person, that the arrangements and configurations illustrated here would also hold true for the chin protector 10', 10", the protective face shield 100' and the assembly 300' of other embodiments according to the present disclosure.

The invention claimed is:

1. A protective helmet comprising:

(i) an optically transparent protective face shield attached to the protective helmet and arrangeable in front of a wearer's face, configured to protect the wearer's face against impact due to flying objects that would otherwise hit and injure the wearer's face, the protective face shield having an inner major surface facing—in use—towards the face of the wearer and an outer major surface facing—in use—away from the wearer's face; and (ii) an optically transparent chin protector formed as a single sheet exhibiting—when not in use—a generally planar configuration and having a visible light transmission of at least 80% according to EN 166:2002-04, the chin protector being bendable by bending about an axis parallel to a major surface thereof such that it can be brought from the generally planar configuration into a curved configuration such that the chin protector substantially forms a u-shape having a round portion and—in use—surrounds the wearer's chin at a spacing, the chin protector comprising inner and outer major surfaces and being attachable in the curved configuration to the inner major surface of the protective face shield at a plurality of spaced engagement portions located 10 to 30 mm inward from an edge of the protective face shield, such that the inner and outer major surfaces of the chin protector protrude substantially perpendicular from the inner major surface of the protective face shield and the round portion of the chin protector faces downward to provide protection from ingress of dust, dirt, droplets or other moving objects or particles from below the wearer's chin; wherein a bend radius rCP of the chin protector is smaller than a radius rFS of a substantially semi-circular lower portion of the protective face shield such that the chin protector does not extend beyond an edge of the protective face shield; and wherein the chin protector comprises polycarbonate.

2. The protective helmet according to claim 1, wherein the chin protector comprises attachment means which are engageable with a portion of the protective face shield to attach the chin protector to the protective face shield; wherein the attachment means comprise pins having compressible enlarged end portions mounted on bars protruding from the chin protector, the pins engage holes in the inner major surface of the face shield.

3. The protective helmet according to claim 2, wherein the attachment means comprises a protrusion protruding from the attachment means, wherein the protrusion is configured and arranged to engage with a receptacle of the protective face shield, wherein each pin comprises a compressible enlarged portion configured to snap-fit into a corresponding receptacle hole and be releasable.

4. The protective helmet according to claim 1, wherein an edge of the chin protector abuts the inner major surface of the protective face shield along at least part of its length.

5. The protective helmet according to claim 1, wherein a gap of 1-5 mm is provided between an edge of the chin protector and the inner major surface of the protective face shield.

6. The protective helmet according to claim 1, wherein the chin protector and the protective face shield comprise the same material and have substantially the same optical transmission.

7. The protective helmet according to claim 1, wherein when in the curved configuration, the chin protector exhibits substantially equidistant spacing around the wearer's chin.

* * * * *